US005690101A

United States Patent [19]

Kutta

[11] Patent Number: 5,690,101

[45] Date of Patent: Nov. 25, 1997

[54] PORTABLE AIR PURIFIER WITH CHEMICAL REACTION ZONE

[76] Inventor: Helmuth W. Kutta, 1110 Lookout Dr., Richardson, Tex. 75080

[21] Appl. No.: 688,605

[22] Filed: Jul. 30, 1996

Related U.S. Application Data

[63] Continuation-in-part of Ser. No. 502,611, Jul. 14, 1995, abandoned.

[51] Int. Cl.[6] ..... A62B 7/10; A62B 7/00

[52] U.S. Cl. ..... 128/205.27; 128/205.28; 128/202.26

[58] Field of Search ..... 128/205.27, 205.28, 128/205.29, 202.22, 202.26, 204.13, 203.23, 201.25

[56] References Cited

U.S. PATENT DOCUMENTS

| | | | |
|---|---|---|---|
| 5,365 | 11/1847 | Morton et al. | 128/204.13 |
| 298,802 | 5/1884 | Warren | 128/203.29 |
| 759,885 | 5/1904 | Haughey | 128/203.23 |
| 786,112 | 3/1905 | Good | 128/203.23 |
| 813,425 | 2/1906 | Hill | 128/203.23 |
| 1,105,934 | 8/1914 | Stevens | 128/204.13 |
| 1,111,055 | 9/1914 | Carveth | 422/122 X |
| 3,406,501 | 10/1968 | Watkins | 96/135 |
| 3,507,621 | 4/1970 | Goodman et al. | 96/151 |
| 3,565,068 | 2/1971 | Bickford | 128/201.25 |
| 3,565,071 | 2/1971 | Cobb et al. | 128/203.24 |
| 3,918,451 | 11/1975 | Steil | 128/203.21 |
| 4,185,083 | 1/1980 | Walker | 423/449 |
| 4,212,846 | 7/1980 | Wise | 422/122 |
| 4,259,303 | 3/1981 | Nakaji et al. | 423/239 |
| 4,696,295 | 9/1987 | Constance-Hughes | 128/202.26 |
| 4,917,108 | 4/1990 | Mault | 128/718 |
| 4,963,327 | 10/1990 | Russell | 422/120 |
| 5,038,768 | 8/1991 | McGoff et al. | 128/202.26 |
| 5,058,578 | 10/1991 | Weiss | 128/205.27 |
| 5,080,094 | 1/1992 | Tayebi | 128/205.29 |

FOREIGN PATENT DOCUMENTS

| | | | |
|---|---|---|---|
| 2 276 840 | 1/1976 | France | 128/205.27 |
| 509 032 | 10/1930 | Germany | 128/205.27 |
| 1 092 310 | 11/1960 | Germany . | |
| 2 316 278 | 10/1974 | Germany . | |
| 29 23 129 | 12/1979 | Germany | 128/205.28 |

(List continued on next page.)

OTHER PUBLICATIONS

"Military Problems with Aerosols and Nonpersistent Gases," Summary Technical Report of Division 10, National Defense Research Committee, Washington, DC, 1946.

"Final Report on Studies on Impregnation," Division B, National Defense Research Committee, Washington, DC, Apr. 1942.

*Primary Examiner*—Vincent Millin
*Assistant Examiner*—Eric P. Raciti
*Attorney, Agent, or Firm*—John W. Montgomery

[57] ABSTRACT

A portable air purifier device for emergency use by an individual in an atmosphere that contains air which has been contaminated with one or more combustion products, said combustion products comprising at least in part a mixture of particulate matter, carbon monoxide and other toxic chemical entities, said device comprising an elongated hollow body having an atmosphere inlet end and an outlet end, said outlet end terminating in a mouthpiece so that said atmosphere can be inhaled by way of a human user's mouth sequentially through said inlet end, body and mouthpiece, said body comprising a plurality of zones for treating said contaminated air as it passes therethrough, one of said plurality of zones is a carbon monoxide removal and fixation zone being adapted to remove and fix said carbon monoxide and another one of said plurality of zones is a toxic chemical reaction and fixation zone adapted to chemically react with said other toxic chemical entities having a porous support material impregnated with reaction chemicals for conversion of said toxic chemical entities and a liquid to solid defined compounds and to liquid non-volatile defined compounds which remain fixed to said support material, whereby said contaminated air can be purified sufficiently to allow breathing of same by said human user for a predetermined short time period.

36 Claims, 2 Drawing Sheets

FOREIGN PATENT DOCUMENTS

| | | | |
|---|---|---|---|
| 34 05 100 | 8/1985 | Germany | 128/205.27 |
| 34 95 048 | 8/1985 | Germany | 128/205.27 |
| 35 07 486 | 9/1986 | Germany | 128/205.28 |
| 53-56894 | 5/1978 | Japan | 128/205.28 |
| 54-147693 | 11/1979 | Japan . | |
| 54-152391 | 11/1979 | Japan | 128/205.27 |
| 61-20566 | 1/1986 | Japan | 128/205.27 |
| 61-2876 | 1/1986 | Japan | 128/205.27 |
| 61-2877 | 1/1986 | Japan | 128/205.27 |
| 62-87174 | 4/1987 | Japan | 128/205.27 |
| 167283 | 1/1965 | U.S.S.R. | 128/205.27 |
| 2 141 349 | 12/1984 | United Kingdom | 128/205.27 |
| 88/09205 | 12/1988 | WIPO | 128/205.27 |
| 92/21408 | 12/1992 | WIPO | 128/205.29 |

PORTABLE AIR PURIFIER WITH CHEMICAL REACTION ZONE

This is a continuation-in-part of U.S. patent application Ser. No. 08/502,611, filed Jul. 14, 1995, now abandoned, which is incorporated herein by reference for all purposes and upon which Applicant relies for priority.

BACKGROUND OF THE INVENTION

From time to time, individuals may find themselves suddenly subjected to an air-containing atmosphere which is contaminated by a substantial variety of combustion products, for example, a smoke-filled hallway in a building, the interior of a burning airplane, and the like. Often in such cases, only a few minutes of additional breathing time is necessary to achieve a safe exit. However, the atmosphere can be so contaminated with combustion products that even a few minutes of normal breathing time is impossible without some artificial help.

This invention is directed to a portable, individual air purifier device which an individual can readily carry with himself or herself and employ for a short period of time to clear the air of a number of life-threatening toxic contaminates out of the atmosphere while the individual is making a safe exit from the contaminated area. This invention does not provide an air supply, but rather, is designed only to clean up the existing air supply to an extent that will allow the user enough additional, temporary breathing time to find his or her way out of the contaminated area.

SUMMARY OF THE INVENTION

In accordance with this invention, there is provided a portable, individual air purifier device for use in an atmosphere that contains air which has been contaminated with certain combustion products, the device having a body which contains a plurality of zones, at least one zone adapted for removal from the air stream by chemical reaction of certain toxic chemicals normally present in modern-day combustion products to form soluble salts and to cause fixation thereof in the air purifier device and at least one other zone being adapted to remove carbon monoxide from the contaminated air, whereby the contaminated air can be purified sufficiently of certain contaminants to allow breathing of same for a limited time.

Accordingly, it is an object of this invention to provide a new and improved device for temporarily purifying air of certain contaminants for an individual user. It is another object to provide a new and improved device for providing an individual caught in a contaminated air-containing atmosphere with some additional breathing time until a safe exit can be found.

Other aspects, objects and advantages of this invention will be apparent to those skilled in the art from this disclosure and the appended claims.

BRIEF DESCRIPTION OF THE DRAWINGS

The foregoing objects, advantages, and features, as well as other objects and advantages, will become more apparent with reference to the description and drawings below, in which like numerals represent like elements and in which.

DETAILED DESCRIPTION OF THE PREFERRED EMBODIMENTS

Figure 1:
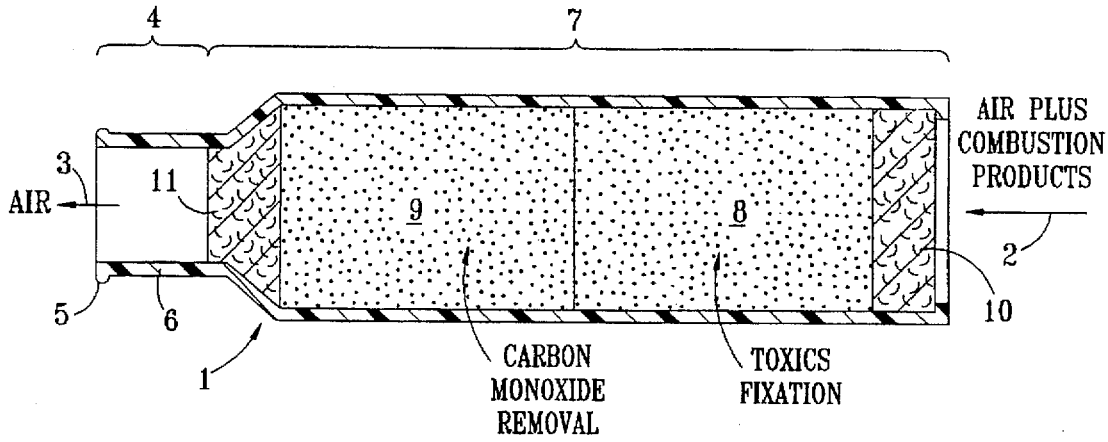
FIG. 1 shows a longitudinal cross-section of a device within the scope of this invention.

More specifically, as shown in FIG. 1, there is provided a purifier device 1 which has an inlet end, as indicated by arrow 2, and an outlet end, as indicated by arrow 3, the outlet end being terminated by a mouthpiece 4 composed of an annular raised ridge 5 and a hollow section 6 which can be gripped by the mouth of the user or otherwise held at the user's mouth, as for example with one hand, during egress. Body 7 of device 1 is composed of a plurality of zones for treating and/or removing combustion products form the air that passes into the body by way of inlet 2. In the embodiment of FIG. 1, body 7 is comprised of two major zones. Zone 8 is for removing, by chemical reaction, certain toxic entities and combustion products from the air passing through that zone 8 and fixing or otherwise holding the resulting precipitates by which the toxic entities are removed in that zone 8. Advantageously, zone 8 is for the conversion and removal by fixation of toxic entities as are known to be present in the smoke of fires where human beings may be present, such as house fires, building fires, hotel fires, automotive fires, bus fires and airplane fires. Zone 9 is designed to remove carbon monoxide from the air atmosphere passing therethrough and to hold or otherwise fix the removed carbon monoxide in that zone. Also advantageously, there can be other zones, for example, zone 10, which provides filtering of solid particulate components of smoke out of the smoke filled air passing therethrough, and may also be advantageously present to fix carbon dioxide formed in zone 9 so that the concentration of carbon dioxide is decreased and, therefore, the percentage of oxygen per breath is increased. A zone 11 may also be a particulate filter to insure that precipitates resulting in the other zones cannot pass through the purifier device. Section 6 can be left open and hollow or can contain a particulate filtering medium as well as desired.

Figure 2:
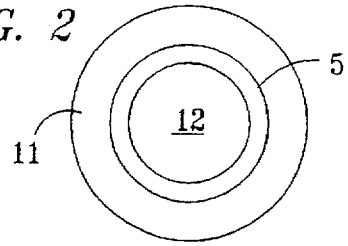
FIG. 2 shows the outlet or mouthpiece end of the device of FIG. 1.

FIG. 2 shows the outlet end 3 of the device of FIG. 1 and shows mouthpiece 4 to have a hollow opening 12 for the flow of purified air therethrough into the user's mouth for breathing purposes.

Figure 3:
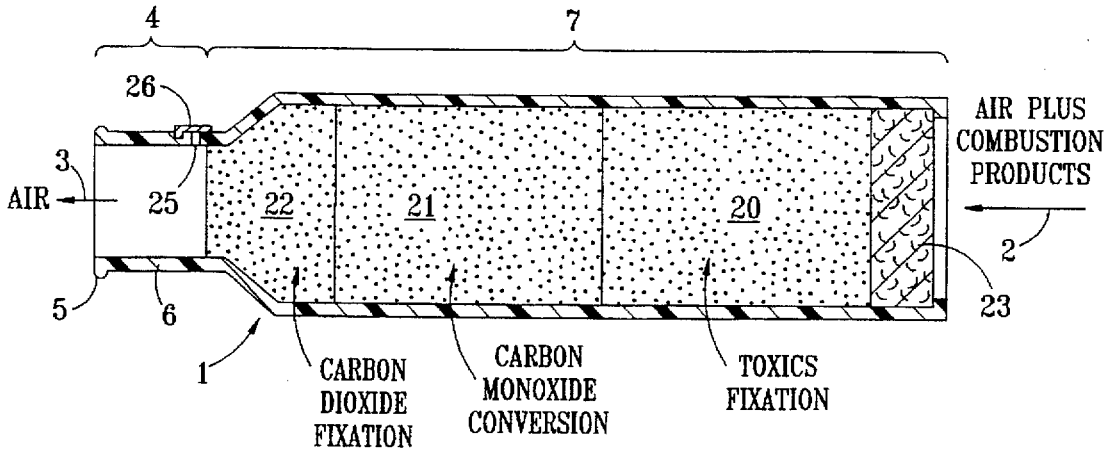
FIG. 3 shows a longitudinal cross-section of another device within the scope of this invention.

FIG. 3 shows another embodiment of an air purifier device within the scope of this invention wherein between the inlet end 2 and mouthpiece 4, body 7 contains a toxins fixation zone 20 followed by a carbon monoxide conversion zone 21 which converts carbon monoxide to carbon dioxide. Zone 21 is, in turn, followed by a carbon dioxide removal and fixation zone 22. Carbon monoxide present in zone 21 is converted to harmless carbon dioxide. However, as the carbon dioxide in the air effectively reduces the percentage of oxygen the carbon dioxide is advantageously removed from the air in zone 22. This effectively raises the concentration of oxygen which is breathed through the purifier device. Other purification zones (e.g., zone 23) can be employed in body 7 as particulate filtering zones or as other chemical removal and fixation zones for other toxic entities (not shown). Section 6 can be provided with a suitable aperture 25 and one-way exhale flap 26 so the user can exhale through same.

Figure 4:
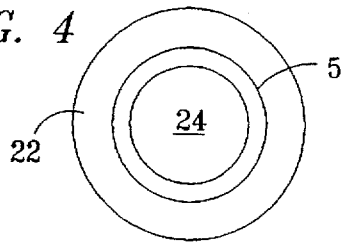
FIG. 4 shows the outlet or mouthpiece end of the device of FIG. 4.

FIG. 4 shows the outlet end of the device of FIG. 3 and shows mouthpiece 4 to have a hollow center 24 through which purified air passes for breathing purposes.

Figure 5:
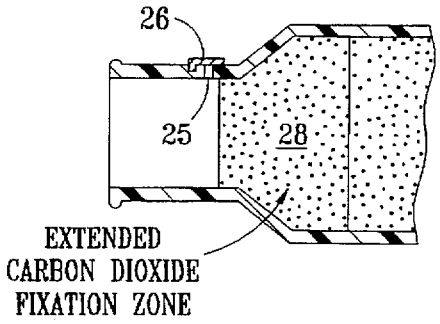
FIG. 5 shows a partial cross-sectional view of an alternative embodiment of a device within the scope of this invention in which the carbon dioxide fixation zone is extended.

FIG. 5 shows, in partial cross-sectional view, an alternative embodiment in which exhaling of carbon dioxide from the mouth is accommodated with an additional quantity of carbon dioxide fixation material 28. Thus, the capacity of the carbon dioxide fixation material is made to be adequate for both removing the carbon dioxide, which has been converted from carbon monoxide in the preceding carbon monoxide conversion section 21, without such zone being saturated through the fixation of carbon dioxide from exhaling by the user.

Figure 6:
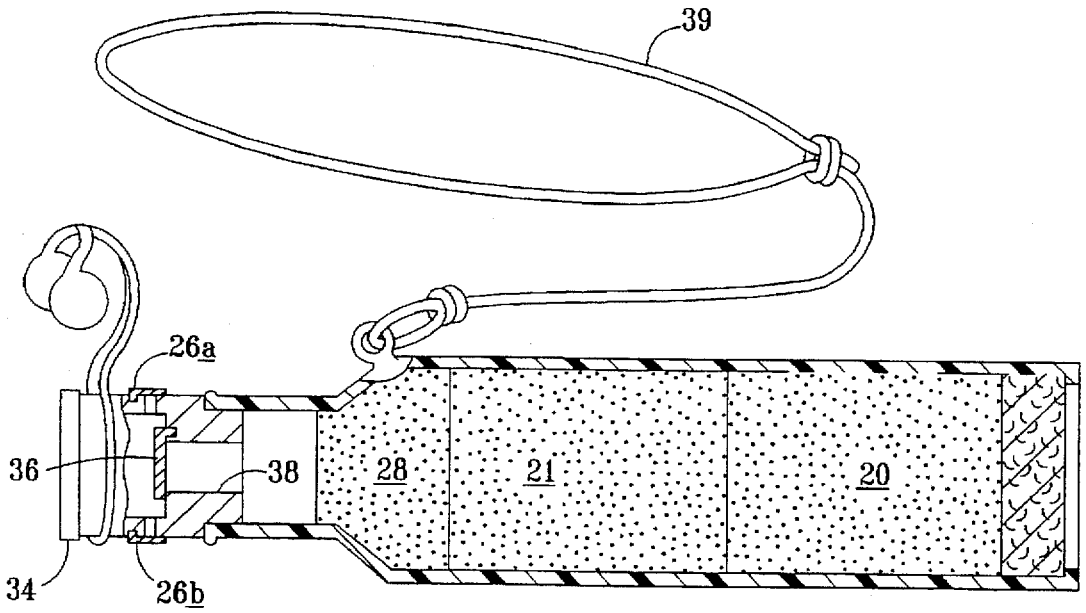
FIG. 6 is another alternative embodiment of a device according to the present invention in which an add-on mouthpiece, having a plurality of flapper valves to permit through-the-mouth exhaling without contaminating the carbon dioxide fixation zone, and also depicting an optional nose plug.

FIG. 6 shows another alternative embodiment in which saturation of the carbon dioxide fixation material, due to exhaling, can be prevented through the use of appropriate flapper valves. Although the device, as depicted, could be constructed integrally with the air purifier device, an add-on mouthpiece 34 can be provided to allow the user to select between through-the-nose exhaling with the device in its simplest form, or alternatively, through-the-mouth exhaling by inserting the add-on device 34 into the mouthpiece opening 36, as depicted in FIG. 6. The valve arrangement provides a plurality of exhale flapper valves **26*a* and 26*b* and also provides an internal flapper valve 36, which abuts against the periphery of orifice 38 to prevent carbon dioxide, which is exhaled by the user from saturating the carbon dioxide fixation zone. This leaves the $CO_2$ fixation zone at a reasonable size for removing all of the carbon dioxide, which has been converted in the carbon monoxide conversion zone. Thus, the oxygen concentration of the air-plus-combustion-products filtered through the air purifier device is maintained at an acceptable high level for an acceptably long duration of two or three minutes to increase the chances of survival in an emergency situation where toxic combustion products or other toxic chemicals are present. For convenience, a support loop 39** may be affixed to allow hand-free carrying of the air purifier.

Figure 7:
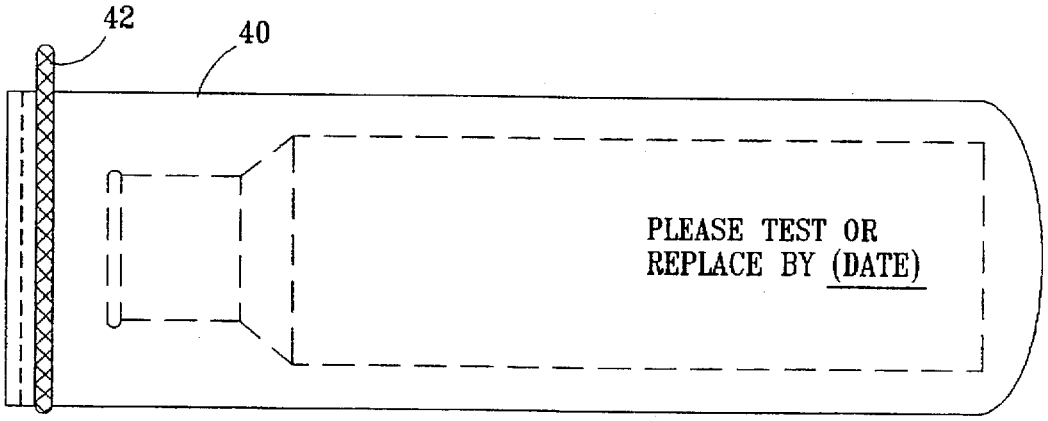
FIG. 7 depicts a sealed plastic bag container by which the inventive device is maintained sealed from ambient atmosphere until the container is torn open for use.

FIG. 7 shows an air purifier device, according to the present invention, which is sealed within a tamper-resistant plastic bag container. The sealed plastic bag container 40 preferably prevents the reactive chemicals within the device from inadvertently becoming partially exposed to combustion products or other toxic products, thereby reducing effectiveness in an emergency. The user merely opens the bag and removes the fresh air purifier for use. Preferably, a tear-open indicator 42 is provided to both allow ease of removal of the air purifier device, and further to provide an indicator to a subsequent user that the device has previously been removed. Although it has been found that without significant amounts of contaminated air flow drawn directly through the purifier device, the chemical constituents of the chemical reaction zones will maintain their potency and will continue to be reactive for emergency air purification even after long periods of exposure to normal atmospheric air. However, in the event that over a long period of time in any particular environment the chemicals become deactivated, dated packages can be provided to allow the user to safely replace the air purifier device according to an appropriate time schedule to ensure that maximum air purification capabilities are maintained for emergency situations.

The materials employed in the various zones of a device within this invention are preferably solid or semi-solid materials which have sufficient porosity, pore volume and surface area with minimum pressure drop to allow the passage of an adequate volume of air therethrough for breathing purposes. The materials employed in such zones preferably either (1) physically remove the impurity, such as dust and ash particulates, removed by way of a physical filter or (2) chemically react with and remove certain contaminants in the airstream by quickly forming, preferably essentially upon contact, one or more insoluble or other easily removable or harmless compounds so that the combined removal of the contaminants, both physically and chemically, is effected at a rate sufficient to sustain the required breathing rate of the user.

The particulate filters can be employed in any well-known physical form. For example, fine wire mesh filters or perforated metal or plastic discs can be employed. Other suitable mediums are cotton or similar fibrous materials through which air readily flows. The particulate filter medium need not be strictly a physical filter. It can serve as well chemically to remove one or more contaminants. For example, a porous charcoal medium would filter out solid particles from the air while serving simultaneously to some extent as a carbon monoxide absorber. One or more particulate filter zones can be employed in any of the devices of this invention. For example, zones 10 and 11, as well as section 6, can be made to contain a particulate filter medium, or only one of such zones, or any combination of two or more of such zones could be employed for such purpose. Similar reasoning applies to zone 23 and section 6 of the device of FIG. 3. Generally, inlet end zones 10 and 23 will serve as primary particulate removal zones, but this is not required in order to achieve some of the other desirable effects of this invention. Particularly, the toxic chemical reaction and fixation zones throughout the length of air purifier device 1 can be employed for such purpose in lieu of or in addition to inlet or outlet particulate filtering zones.

The toxic fixation zones 8 and 20 of FIGS. 1 and 3 can contain chemicals or other elements necessary to chemically react certain toxic chemical contaminates to form precipitates which are removed from the air passing therethrough. For example, hydrogen cyanide, hydrogen sulfide, sulfur oxides and nitrogen oxides ($NO_x$) are toxics which, if present, would be desirably removed from the air passing through zones 8 and 20. One or more of these toxic entities are commonly found in the combustion products of house fires, building fires, hotel fires, automotive fires, bus fires and airplane fires and often lead to death or injury to humans before heat or flames reach the humans caught in such fires. Advantageously with this invention, removal of such toxic entities can be accomplished by using reaction chemicals, which quickly (i.e., essentially upon contact) chemically react to form solid salts of the particular toxic entity whether cyanide, sulfide or nitrogen oxide. For example, the desired solid salts of the foregoing toxic entities can be quickly and readily formed by simple contact at room conditions with at least one reaction chemical selected form the group consisting of metal acetates and metal formates. Preferably the metal acetates and metal formates are formed with metals of Group I.B, II.B, IV.A and VIII transition elements, as those groups are set out in the *Handbook of Chemistry and Physics*, Chemical Rubber Company, 51st Edition, 1970–1971, page B-3. Other references to periodic chart Groups refer to the same *Handbook of Chemistry and*

*Physics* Periodic Chart. Of the foregoing metals, preferred metals for acetates and formates are copper (I.B), silver (I.B), lead (IV.A), zinc (II.B), cadmium (II.B), iron (VIII), cobalt (VIII), nickel (VIII) and mixtures of two or more thereof. The most preferred metals being copper, lead and silver. Thus, the preferred examples of impregnated reaction chemicals includes: copper acetate, copper formate, silver acetate, silver formate, lead acetate and lead formate. These materials can be impregnated onto the surface of an inert support material and, particularly, a high surface area material such as a porous guard bed carrier material. For example, cylindrical extrudates, beads, or rashing rings of silica or aluminum oxide and which preferably has a bulk density of from about 15 to about 75 pounds per cubic foot is suitable for impregnation with one or more of the foregoing reaction chemicals. While other inert support materials could be used for fixing the reaction chemicals, the guard bed material preferably should be durable as well as porous so that it is not subject to cracking, fracturing or crumbling which could reduce the efficiency of reactions, could cause dust to be breathed or to clog the porous passages in this toxic chemical reaction zone of the air purifier device.

The indicated reaction chemicals will readily react with toxic gases to convert the toxic gases to solid defined compounds and to liquid non-volatile defined compounds. A toxic gas is chemically converted in a known stoichiometric chemical reaction to defined compounds which are solid or non-volatile and which are fixed on the porous support material. Most preferred of these reaction chemicals which are to be fixed in the porous guard bed for reaction with toxic gases are copper acetate, silver acetate and lead acetate. These chemicals readily react with airborne or gaseous cyanide (HCN), hydrogen sulfide ($H_2S$), sulfur oxides ($SO_x$) and nitrogen oxides ($NO_x$) to form a corresponding solid metal salt and a liquid acetic acid, both of which come out of the gas stream and are fixed onto the guard bed. Because the products of the chemical reaction are fixed to the inert support structure in a chemical reaction without adsorption, there is no risk of de-adsorption which might otherwise release the chemicals back into the air stream.

The resultant acetic acid can also simultaneously serve to desolve and thereby remove some carbon monoxide from the air flow, although this dissolving process is not relied upon as a primary carbon monoxide removal means.

In recent times, terrorism, acts of war or acts of civil disobedience have subjected people in ordinary situations to toxic chemicals, such as cyanide gases as a result of poisonous gas bombings and the like. The present invention can be useful, because of its ability to be impregnated with appropriate materials for removing and holding toxic gases, such as cyanide. In many instances, such heinous attacks or acts of terrorism occur in enclosed areas which can be escaped in a matter of minutes, provided that any remaining air is purified of its toxic content for breathing during the few minutes required to escape. Other attacks which are not in enclosed areas typically dissipate sufficiently quickly in a matter of minutes that significantly increased chances of survival can be provided by the use of an air purification device which removes the most highly toxic poisonous materials for a relatively short period of time. Those skilled in the art will further recognize that situations in which a particular type of gas attack, such as cyanide bombings, which might be most prevalent or most likely in a given locale, can be specifically protected against by providing increased concentrations or increased quantities of the materials most effective for removing or holding the specific toxic materials, such as materials specifically designed for removing and holding cyanide where those types of attacks may have an increased probability of occurring.

In addition to the unique toxic gas reaction and fixation zone as described above, a carbon monoxide removal zone 9 is also provided in the device of FIG. 1. Zone 9 can contain a material which removes carbon monoxide by physical adsorption as, for example, charcoal. Thus, carbon monoxide can be directly removed in one or more zones within the device of this invention.

Advantageously, as shown in FIG. 3, carbon monoxide can first be converted to carbon dioxide in zone 21 and thereafter removed in a separate carbon dioxide fixation zone 22. In the device of FIG. 3, carbon monoxide conversion to carbon dioxide can be achieved by filling zone 21 with granular hopcolite in a porous configuration. This conversion zone, therefore, contains one or more naturally occurring minerals, such as hopcolite, which are known to convert carbon monoxide to carbon dioxide.

In the advantageous embodiment shown in FIG. 3, the carbon dioxide fixation zone 22 that immediately follows carbon monoxide conversion zone 21 uniquely removes the carbon dioxide formed in zone 21. Carbon dioxide can be removed from the airstream and fixed in zone 22 by employing one or more alkali metal hydroxides, alkaline earth metal oxides, and mixtures thereof. Preferred alkali metal and alkaline earth metals employable in this invention are sodium, potassium, magnesium and calcium. Thus, sodium hydroxide, sodium oxide, potassium hydroxide, potassium oxide, magnesium hydroxide, magnesium oxide, calcium hydroxide or calcium oxide can be impregnated into guard bed or filter material in zone 22 to chemically react with and fix the carbon dioxide. Also, naturally occurring minerals known to absorb carbon dioxide (e.g., Ascarite) can be employed. The beneficial result is that the concentration of oxygen can be increased where the otherwise harmless carbon dioxide is removed. Concentrations of sixteen percent (16%) and above, even up to twenty-one percent (21%) and more, can be achieved in an otherwise oxygen deficient environment.

Of course, two or more of the foregoing zones can be combined so that a number of functions are carried out in a single zone. For example, zones 21 and 23 of FIG. 1 could be combined. Zones 8 and 9 of FIG. 1 might also be combined. The beneficial results of this invention could still be achieved. Similar reasoning being applied to combining two or more of any or all of zones 8 through 11 of FIG. 1 and zones 20 through 23 of FIG. 3.

The amounts, concentrations and other quantities or volumes of the foregoing materials in any combination will vary widely, depending upon the severity of conditions under which the device is to be used, the length of time the device is to be used, and the degree of purification desired. Thus, general quantitative recitations of the amounts and concentrations of the various purification materials to be employed is extremely difficult, if not impossible prior to actual fabrication and testing, to state to a certainty. However, it is sufficient to one skilled in the art when fabricating a device within this invention to state that the amount and concentration of each material employed should be that sufficient to provide complete toxic entity and carbon monoxide removal with normal breathing for three to thirty minutes. Preferably, complete removal will be provided upon normal breathing for at least ten minutes of continuous use. For example, normal adult respiration requires approximately 16 breaths per minute at about 700–1200 $cm^3$ per breath or about 112–192 liters of air over a period of ten minutes. Thus, to cover this range, unimpeded air flow of about 20 liters per minute or about 200 liters for a ten minute period should be maintained.

The device is preferably intended to be highly portable and for use by one individual at a time. It is preferred that the device be of a size and weight such that it can be (1) carried, for example, in a user's pocket or purse; (2) employed with one hand for use by the user; and (3) held in place in the user's mouth without other support. Without the necessity of holding the device of this invention in one's mouth with one or both hands, the hands are available for aiding the user during escape from the contaminated atmosphere. Thus, the device of this invention is preferably an elongate cylinder (i.e., approximately the diameter and length of a very large commercially-available cigar, although the weight of the device could be considerably heavier than that of a cigar). However, the portability and usefulness of the device of this invention without hand support by the user should approximate that of a large cigar, if at all possible.

The device of this invention is expected to remove certain toxins from contaminated breathing air in emergency situations only. It is also expected that it will help in cooling the hot air down to a less harmful temperature level for breathing purposes. Thus, the device could be useful in certain emergency situations where a combustion product contaminated atmosphere exists, such as high rise building fires or airplane fires where no alternative safe source of cleaned air is available. This device cannot prevent all possibilities of injury, but it could facilitate providing a temporarily cleaned air supply can keep the user conscious long enough to reach a safe exit.

EXAMPLE 1

A device substantially as shown in FIG. 3 is provided wherein body 7 and mouthpiece 4 are formed of polypropylene. Body 7 is approximately two inches in diameter (about 5 cm) and about six inches long (about 15 cm). Mouthpiece 4 is about one inch in diameter (about 25 cm) and about one inch long (about 2.5 cm). A particulate filter zone 23 is about one-half inch long (about 1.5 cm) and formed from wadded cotton enclosed in an aluminum metal screen having a mesh size of ordinary window screen. Toxic fixation zone 20 is about three inches long (about 7 cm) and contains silver acetate impregnated into a solid particulate alumina bead guard bed material having a bulk density of about fifty pounds (50 lb) per cubic foot. Carbon monoxide conversion zone 21 is about two inches long (about 5 cm) and contains hopcolite granules in a porous configuration. Carbon dioxide fixation zone 22 is about one-half inch long (about 1.5 cm) and contains particulate Ascarite in a mesh size range from about 8 to about 20 microns. Section 6 contains additional cotton wadding for particulate filter purposes. The wadding is held within mouthpiece 6 at either end thereof by aluminum screen. Mouthpiece 4 is about one inch (about 2.5 cm) in diameter and about one inch long (about 2.5 cm). Mouthpiece 4 can be fitted with a rubber hose so that the device 1 can be clipped onto a belt and breathing carried out through the device and the rubber hose thereby obviating the necessity of carrying the entire device at the mouth.

In this Example 1, assuming the presence of cyanide gas, sulfur dioxide, sulfur trioxide, hydrogen sulfide gas and nitrogen oxides, the toxics reaction would be as follows:

| | | |
|---|---|---|
| $CH_3COOAg + HCN$ | $\rightarrow$ | $AgCN + CH_3COOH$ |
| [silver acetate + hydrogen cyanide] | $\rightarrow$ | [salt + acetic acid] |
| $2\ CH_3COOAg + SO_3$ | $\rightarrow$ | $(Ag)_2SO_4 + 2\ CH_3COOH$ |
| $CH_3COOAg + No_x$ | $\rightarrow$ | $AgNO_x + CH_3COOH$ |
| $2\ CH_3COOAg + H_2S$ | $\rightarrow$ | $Ag_2S + 2\ CH_3COOH$ |

Example 2

A device substantially as shown in FIG. 3 is provided wherein body 7 and mouthpiece 4 are formed of polypropylene. Body 7 is approximately two inches in diameter (about 5 cm) and about six inches long (about 15 cm). Mouthpiece 4 is about one inch in diameter (about 25 cm) and about one inch long (about 2.5 cm). A particulate filter zone 23 is about one-half inch long (about 1.5 cm) and formed from wadded cotton enclosed in an aluminum metal screen having a mesh size of ordinary window screen. Toxic fixation zone 20 is about three inches long (about 7 cm) and contains copper acetate impregnated into a solid particulate alumina bead guard bed material having a bulk density of about fifty pounds (50 lb) per cubic foot. Carbon monoxide conversion zone 21 is about two inches long (about 5 cm) and contains HOPCALITE granules in a porous configuration. Carbon dioxide fixation zone 22 is about one-half inch long (about 1.5 cm) and contains particulate Ascarite in a mesh size range from about 8 to about 20 microns. Section 6 contains additional cotton wadding for particulate filter purposes. The wadding is held within mouthpiece 6 at either end thereof by aluminum screen. Mouthpiece 4 is about one inch (about 2.5 cm) in diameter and about one inch long (about 2.5 cm). Mouthpiece 4 can be fitted with a rubber hose so that the device 1 can be clipped onto a belt and breathing carried out through the device and the rubber hose thereby obviating the necessity of carrying the entire device at the mouth.

In this Example 2, assuming the presence of cyanide gas, sulfur dioxide, sulfur trioxide, hydrogen sulfide gas and nitrogen oxides, the toxics reaction would be as follows:

| | | |
|---|---|---|
| $(CH_3COO)_2Cu + 2\ HCN$ | $\rightarrow$ | $Cu(CN)_2 + 2\ CH_3COOH$ |
| [copper acetate + hydrogen cyanide] | $\rightarrow$ | [salt + acetic acid] |
| $(CH_3COO)_2Cu + SO_3$ | $\rightarrow$ | $Cu\ (SO_4) + 2\ CH_3COOH$ |
| $(CH_3COO)_2Cu + No_x$ | $\rightarrow$ | $Cu\ (NO_x)_2 + 2\ CH_3COOH$ |
| $(CH_3COO)_2Cu + 2\ H_2S$ | $\rightarrow$ | $CuS + 2\ CH_3COOH$ |

Example 3

A device substantially as shown in FIG. 3 is provided wherein body 7 and mouthpiece 4 are formed of polypropylene. Body 7 is approximately two inches in diameter (about 5 cm) and about six inches long (about 15 cm). Mouthpiece 4 is about one inch in diameter (about 25 cm) and about one inch long (about 2.5 cm). A particulate filter zone 23 is about one-half inch long (about 1.5 cm) and formed from wadded cotton enclosed in an aluminum metal screen having a mesh size of ordinary window screen. Toxic fixation zone 20 is about three inches long (about 7 cm) and contains lead acetate impregnated into a solid particulate alumina bead guard bed material having a bulk density of about fifty pounds (50 lb) per cubic foot. Carbon monoxide conversion zone 21 is about two inches long (about 5 cm) and contains hopcolite granules in a porous configuration. Carbon dioxide fixation zone 22 is about one-half inch long (about 1.5 cm) and contains particulate Ascarite in a mesh size range from about 8 to about 20 microns. Section 6 contains additional cotton wadding for particulate filter purposes. The wadding is held within mouthpiece 6 at either end thereof by aluminum screen. Mouthpiece 4 is about one inch (about 2.5 cm) in diameter and about one inch long (about 2.5 cm). Mouthpiece 4 can be fitted with a rubber hose so that the device 1 can be clipped onto a belt and breathing carried out through the device and the rubber hose thereby obviating the necessity of carrying the entire device at the mouth.

In this Example 3, assuming the presence of cyanide gas, sulfur dioxide, sulfur trioxide, hydrogen sulfide gas and nitrogen oxides, the toxics reaction would be as follows:

| | |
|---|---|
| $(CH_3COO)_2Pb + 2\ HCN_2$ | $\rightarrow Pb_3(CN) + 2\ CH\ COOH$ |
| [lead acetate + hydrogen cyanide] | $\rightarrow$ [salt + acetic acid] |
| $(CH_3COO)_2Pb + SO_3$ | $\rightarrow Pb(SO_4) + 2\ CH_3COOH$ |
| $(CH_3COO)_2Pb + No_x$ | $\rightarrow Pb(NO_x)_2 + 2\ CH_3COOH$ |
| $(CH_3COO)_2Pb + H_2S$ | $\rightarrow PbS + 2\ CH_3COOH$ |

Example 4

A device substantially as shown in FIG. 3 is provided wherein body 7 and mouthpiece 4 are formed of polypropylene. Body 7 is approximately two inches in diameter (about 5 cm) and about six inches long (about 15 cm). Mouthpiece 4 is about one inch in diameter (about 25 cm) and about one inch long (about 2.5 cm). A particulate filter zone 23 is about one-half inch long (about 1.5 cm) and formed from wadded cotton enclosed in an aluminum metal screen having a mesh size of ordinary window screen. Toxic fixation zone 20 is about three inches long (about 7 cm) and contains silver formate impregnated into a solid particulate alumina bead guard bed material having a bulk density of about fifty pounds (50 lb) per cubic foot. Carbon monoxide conversion zone 21 is about two inches long (about 5 cm) and contains hopcolite granules in a porous configuration. Carbon dioxide fixation zone 22 is about one-half inch long (about 1.5 cm) and contains particulate Ascarite in a mesh size range from about 8 to about 20 microns. Section 6 contains additional cotton wadding for particulate filter purposes. The wadding is held within mouthpiece 6 at either end thereof by aluminum screen. Mouthpiece 4 is about one inch (about 2.5 cm) in diameter and about one inch long (about 2.5 cm). Mouthpiece 4 can be fitted with a rubber hose so that the device 1 can be clipped onto a belt and breathing carried out through the device and the rubber hose thereby obviating the necessity of carrying the entire device at the mouth.

In this Example 4, assuming the presence of cyanide gas, sulfur dioxide, sulfur trioxide, hydrogen sulfide gas and nitrogen oxides, the toxics reaction would be as follows:

| | |
|---|---|
| $HCOOAg + HCN$ | $\rightarrow AgCN + HCOOH$ |
| [silver formate + hydrogen cyanide] | $\rightarrow$ [salt + formic acid] |
| $2\ HCOOAg + SO_3$ | $\rightarrow (Ag)_2SO_4 + 2\ HCOOH$ |
| $HCOOAg + No_x$ | $\rightarrow AgNO_x + HCOOH$ |
| $2\ HCOOAg + H_2S$ | $\rightarrow Ag_2S + 2\ HCOOH$ |

Reasonable variations and modifications are possible within the scope of this disclosure without departing from the spirit of the invention.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A portable air purifier device for emergency use by an individual in an atmosphere that contains air which has been contaminated with one or more combustion products, said combustion products comprising at least in part a mixture of particulate matter, carbon monoxide and other toxic chemical entities, said device comprising an elongated hollow body having an atmosphere inlet end and an outlet end, said outlet end terminating in a mouthpiece so that said atmosphere can be inhaled by way of a human user's mouth sequentially through said inlet end, body and mouthpiece, said body comprising a plurality of zones for treating said contaminated air as it passes therethrough, one of said plurality of zones is a carbon monoxide removal and fixation zone being adapted to remove said carbon monoxide and to fix it to a porous substrate and another one of said plurality of zones is a toxic chemical reaction and fixation zone adapted to chemically react with said other toxic chemical entities having a porous support material impregnated with reaction chemicals for conversion of said toxic entities to solid defined compounds and to liquid non-volatile defined compounds which remain fixed to said support material, whereby said contaminated air can be purified sufficiently to allow breathing of same by said human user for a predetermined short time period.

2. The device of claim 1 wherein said body is of a size and weight such that it can be conveniently carried by a human user's and can be employed with one hand of said human user and held in place in said human user's mouth without other support.

3. The device of claim 2 wherein said body is an elongate cylinder which has a diameter of about 2 inches (about 5 cm) and a length of about 6 inches (about 15 cm) and said mouthpiece having a diameter of about one inch (about 2.5 cm) and a length of about one inch (about 2.5 cm) which thereby approximates the diameter and length of a large commercially-available cigar.

4. The device of claim 2 wherein said outlet end is sized to be placed in the user's mouth and further comprises a one-way valve outlet through which the user may exhale through the mouth without removing the mouthpiece.

5. The device of claim 1 further comprising at least one particulate filter zone in said body, which particulate filter zone physically removes at least some particulate matter from said contaminated air and holds said removed particulate matter in said filter zone.

6. The device of claim 1 wherein said particulate filter zone is carried at or near said inlet end.

7. The device of claim 6 further comprising at least one additional particulate filter zone carried in said body at or near said outlet end.

8. The device of claim 1 further comprising a particulate filter zone and a carbon dioxide removal and fixation zone, and wherein said body carries in sequence from said inlet end to said outlet end said particulate filter zone, said toxic chemical reaction and fixation zone, said carbon monoxide conversion zone, followed by said carbon dioxide removal and fixation zone.

9. The device of claim 8 wherein said mouthpiece further comprises a one-way valve to allow exhaling therethrough without removal and further comprising said at least one carbon dioxide removal and fixation zone having a sufficient volume to accommodate fixation of exhaled carbon dioxide without saturation during said predetermined short time period.

10. The device of claim 9 further comprising a nose plug attached to said air purifier, adapted to be placed on the user's nose while using the air purifier to remind the user to breath only through the mouth.

11. The device of claim 8 further comprising an add-on mouthpiece comprising means for attaching said add-on mouthpiece to said air purifier device, a one-way exhaling valve to allow exhaling therethrough, and a one-way inhaling valve allowing drawing of purified air through said air purifier into said add-on mouthpiece while preventing exhaled carbon dioxide from entering said carbon dioxide removal and fixation zone.

12. The device of claim 11 further comprising a nose plug attached to said air purifier, adapted to be placed on the user's nose while using the air purifier to remind the user to breath only through the mouth.

13. The device of claim 8 further comprising a final particulate filter zone at said outlet end of said body.

14. The device of claim 1 wherein said toxic chemical reaction and fixation zone for removing and holding said toxic chemical entities comprises a reaction chemical impregnated onto a guard bed support material, which reaction chemical will chemically react with hydrogen cyanide, hydrogen sulfide, nitrogen oxides, and mixtures of two or more thereof to produce defined precipitates and non-volatile compounds in a stoichiometric chemical reaction so that said defined precipitates and non-volatile compounds remain fixed to said support material without adsorption and, therefore, without risk of de-adsorption.

15. The device of claim 8 wherein said at least one toxic chemical reaction and fixation zone contains at least one reaction chemical on a support material which, essentially upon contact with hydrogen cyanide, hydrogen sulfide, and/or nitrogen oxides, forms corresponding insoluble salts of cyanide, sulfur and/or nitrogen oxides.

16. The device of claim 15 wherein said at least one reaction chemical is selected from the group consisting of metal acetate and metal formate, and mixtures thereof.

17. The device of claim 16 wherein the metal in said at least one metal acetate and metal formate is selected from the group consisting of transition elements of Group I.B, II.B, IV.A and VIII metals.

18. The device of claim 17 wherein said metal is selected from the group consisting of copper, silver, zinc, cadmium, iron, cobalt, lead, nickel, and mixtures of two or more thereof.

19. The device of claim 17 wherein said metal is selected from the group consisting of copper, silver and lead.

20. The device of claim 8 wherein said carbon monoxide to carbon dioxide conversion zone contains the mineral HOPCALITE.

21. The device of claim 8 wherein said at least one carbon dioxide removal and fixation zone contains at least one material selected from the group consisting of alkali metal hydroxide, alkaline earth metal oxide, and mixtures thereof.

22. The device of claim 21 wherein said carbon dioxide removal and fixation zone zone contains sodium hydrate-asbestos absorbent.

23. The device of claim 8 wherein said at least one carbon monoxide removal and fixation zone further comprises charcoal.

24. The device of claim 8 further comprising a protective sealed tear-open plastic bag enclosing said air purifier to protect the chemical constituents from the atmosphere until removal of the tear-open bag for use.

25. The device of claim 8 further comprising a convenient support strap attached for allowing hands-free carrying thereof.

26. The device of claim 1 wherein said body carries in sequence from said inlet end to said outlet end a particulate filter zone, a toxic chemical reaction and fixation zone which contains at least one metal acetate, at least one zone for converting carbon monoxide to carbon dioxide which contains hopcolite, and further comprising, next in said sequence, at least one zone for removal and fixation of carbon dioxide which contains at least one material selected from the group consisting of alkali metal hydroxide, alkaline earth oxide, and mixtures of two or more thereof.

27. The device of claim 26 wherein said metal acetate is selected from the group of metals consisting of copper, silver, lead, zinc, cadmium, iron, cobalt, nickel and mixtures thereof, and said material of said at least one zone for removal and fixation of carbon dioxide is selected from the group consisting of sodium hydroxide, potassium hydroxide, magnesium hydroxide and calcium hydroxide.

28. The device of claim 27 wherein said body carries a particulate filter zone at both its inlet end and its outlet end.

29. The device of claim 28 wherein said metal acetate is selected from the group consisting of silver acetate, lead acetate and copper acetate, said at least one zone for converting carbon monoxide to carbon dioxide contains hopcolite, and said at least one zone for removal and fixation of carbon dioxide contains sodium hydrate-asbestos absorbent.

30. The device of claim 1 further comprising a third one of said plurality of zones which is a carbon dioxide removal and fixation zone for receiving carbon dioxide from said carbon monoxide conversion zone and for chemically reacting with received carbon dioxide and for fixing the reaction products so that a high concentration of oxygen in said purified air is maintained.

31. The device as in claim 15 wherein said at least one reaction chemical comprises silver acetate.

32. The device as in claim 15 wherein said at least one reaction chemical comprises copper acetate.

33. The device as in claim 15 wherein said at least one reaction chemical comprises silver formate.

34. The device as in claim 15 wherein said at least one reaction chemical comprises copper formate.

35. The device as in claim 15 wherein said at least one reaction chemical comprises lead acetate.

36. The device as in claim 15 wherein said at least one reaction chemical comprises lead formate.

* * * * *